US006045985A

United States Patent [19]

Cavalleri et al.

[11] Patent Number: 6,045,985

[45] Date of Patent: Apr. 4, 2000

[54] LIGHT-SENSITIVE SILVER HALIDE PHOTOGRAPHIC ELEMENTS CONTAINING YELLOW FILTER DYES

[75] Inventors: Piero Cavalleri, Pieve Di Teco; Sergio Massirio, Finale Ligure, both of Italy

[73] Assignee: Tulalip Consultoria Comercial Sociedade Unipessoal S.A., Portugal

[21] Appl. No.: 09/198,818

[22] Filed: Nov. 23, 1998

[30] Foreign Application Priority Data

Dec. 2, 1997 [EP] European Pat. Off. ..... 97121107

[51] Int. Cl.[7] ..... G03C 1/46

[52] U.S. Cl. ..... 430/507; 430/510; 430/517; 430/522

[58] Field of Search ..... 430/507, 510, 430/517, 522

[56] References Cited

U.S. PATENT DOCUMENTS

| | | |
|---|---|---|
| 3,282,699 | 11/1966 | Jones et al. . |
| 3,337,344 | 8/1967 | Kimura et al. . |
| 3,386,301 | 6/1968 | Koyama . |
| 3,418,127 | 12/1968 | Millikan . |
| 3,418,129 | 12/1968 | Kimura et al. . |
| 3,455,693 | 7/1969 | Heseltine et al. . |
| 3,476,560 | 11/1969 | Yasuda . |
| 3,476,564 | 11/1969 | Mariani et al. . |
| 3,554,755 | 1/1971 | Rinauro . |
| 3,580,722 | 5/1971 | Sakamoto et al. . |
| 3,632,345 | 1/1972 | Marx et al. . |
| 3,639,417 | 2/1972 | Porter et al. . |
| 3,650,757 | 3/1972 | Irie et al. . |
| 3,716,276 | 2/1973 | Wilson et al. . |
| 3,748,141 | 7/1973 | Smith, Jr. . |
| 3,790,386 | 2/1974 | Posse et al. . |
| 3,790,387 | 2/1974 | Musliner . |
| 3,799,765 | 3/1974 | Clarke, Jr. . |
| 3,801,326 | 4/1974 | Claes . |
| 3,892,572 | 7/1975 | Shiba et al. . |
| 3,897,935 | 8/1975 | Forster et al. . |
| 3,917,485 | 11/1975 | Morgan . |
| 3,928,041 | 12/1975 | Fujiwhara et al. . |
| 3,934,802 | 1/1976 | Jennings . |
| 3,938,996 | 2/1976 | Fujiwhara et al. . |
| 3,979,213 | 9/1976 | Gilman, Jr. et al. . |
| 4,046,376 | 9/1977 | Harvey et al. . |
| 4,080,211 | 3/1978 | Van Paesschen et al. . |
| 4,138,258 | 2/1979 | Hirose et al. . |
| 4,147,551 | 4/1979 | Finnicum et al. . |
| 4,171,224 | 10/1979 | Verhille et al. . |
| 4,199,363 | 4/1980 | Chen . |
| 4,203,716 | 5/1980 | Chen . |
| 4,214,047 | 7/1980 | Chen . |
| 4,353,979 | 10/1982 | Terada et al. . |
| 4,366,237 | 12/1982 | Ichijima et al. . |
| 4,420,555 | 12/1983 | Krueger et al. . |
| 4,430,421 | 2/1984 | Van de Sande et al. . |
| 4,430,422 | 2/1984 | Van de Sande et al. . |
| 4,451,559 | 5/1984 | Sato et al. . |
| 4,923,788 | 5/1990 | Shuttleworth et al. . |

FOREIGN PATENT DOCUMENTS

| | | | |
|---|---|---|---|
| 0 096 873 B1 | 12/1987 | European Pat. Off. . | |
| 0 549 489 A1 | 6/1993 | European Pat. Off. . | |
| 0 552 010 A1 | 7/1993 | European Pat. Off. . | |
| 0 697 758 A2 | 2/1996 | European Pat. Off. . | |
| 0 738 918 A1 | 10/1996 | European Pat. Off. . | |
| 788890 | 8/1997 | European Pat. Off. ..... | B41M 5/38 |
| 3-220551 | 9/1991 | Japan . | |
| 4-9042 | 1/1992 | Japan ..... | G03C 1/12 |
| 4-177241 | 6/1992 | Japan . | |

*Primary Examiner*—Richard L. Schilling
*Assistant Examiner*—Amanda C. Walke

[57] ABSTRACT

Photographic elements are disclosed having on a support a silver halide emulsion layer sensitive to radiation other than blue light in addition to its intrinsic sensitivity to blue region, and a yellow filter layer between the silver halide emulsion layers and the source of exposure, the yellow filter layer containing a yellow filter dye represented by the structural formula:

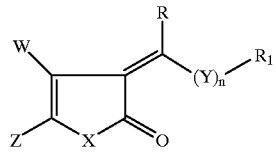

wherein:
R is hydrogen, alkyl group or aryl group;
$R_1$ is aryl group or heterocyclic group;
X is O or N—$R_2$ where $R_2$ is hydrogen or alkyl group;
Y is N—$R_3$ where $R_3$ is hydrogen or alkyl group;
n is 0 or 1;
Z is hydrogen, alkyl group or aryl group;
W is hydrogen, or W and Z, taken together, represent the atoms necessary to form an aryl group.

In particular, multilayer color photographic elements are disclosed having thereon a support base, in order from the support, red-, green-, and blue-sensitive silver halide emulsion layers respectively associated with non-diffusing cyan, magenta and yellow dye-forming couplers, wherein a yellow filter layer containing the yellow filter dyes of the above structural formula is positioned below the blue-sensitive layer(s) and above the green-sensitive layer(s) and the red-sensitive layer(s).

The photographic elements herein disclosed provide yellow filter layers which have the required spectral absorption characteristics, are easily bleached during photographic processing steps, and do not suffer from stain problems after processing and incubative aging.

6 Claims, No Drawings

LIGHT-SENSITIVE SILVER HALIDE PHOTOGRAPHIC ELEMENTS CONTAINING YELLOW FILTER DYES

FIELD OF THE INVENTION

The present invention relates to silver halide color photographic light-sensitive elements containing yellow filter dyes and, more particularly, to silver halide color photographic light-sensitive elements in which one or more of the light-sensitive layers is protected against exposure to blue light by a layer containing a yellow filter dye.

BACKGROUND OF THE INVENTION

It is well known that light-sensitive silver halide color photographic elements, using the subtractive process for color reproduction, comprise silver halide emulsion layers selectively sensitive to blue, green and red light and associated with yellow, magenta and cyan dye-forming couplers which form (upon exposure and reaction with an oxidized primary amine type color developing agent) the complementary color thereof. For example, an acylacetanilide type coupler is used to form a yellow color image; a 5-pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive elements comprise non-diffusible couplers incorporated independently in each of the light-sensitive layers of the material (incorporated coupler materials). Therefore, a color photographic light-sensitive element usually comprises 1) a blue-sensitive silver halide emulsion layer (or layers) which contains a yellow dye-forming coupler and which is sensitive to blue light (substantially to wavelengths less than about 500 nm); 2) a green-sensitive silver halide emulsion layer (or layers) which contains a magenta dye-forming coupler and which is mainly sensitive to green light (substantially to wavelengths of about 500 to 600 nm); and 3) a red-sensitive silver halide emulsion layer (or layers) which contains a cyan dye-forming coupler and which is mainly sensitive to red light (substantially to wavelengths longer than about 590 nm). The green-sensitive and the red-sensitive silver halide emulsion layers are rendered sensitive to the green and red regions of the spectrum by associating a spectral sensitizing dye therewith, but retain their inherent sensitivity to blue light.

The differently colored sensitive silver halide emulsion layers are coated on a film base, such a cellulose triacetate (CTA) film or a polyethylenenaphthalate (PEN) film, wherein the uppermost layer (or layers) is the blue-sensitive silver halide emulsion layer (or layers). Thus, to prevent any blue light which passes through the blue sensitive layer from striking the lower sensitive layers, which in addition to being sensitized to particular parts of the spectrum are also sensitive to blue light, and causing a false color rendition, it is common practice to interpose between the source of exposition and the silver halide emulsion layers intended for recording the green and red light, a blue light absorbing layer. Such a layer, usually referred to in the art as yellow filter layer, is commonly interposed between the blue-sensitive silver halide emulsion layer (or layers) and all of the green- and red-sensitive silver halide emulsion layers. The yellow filter layer is useful in absorbing blue light during exposure and must be removed during processing of the photographic element.

As a yellow filter layer it has been a common practice to use a gelatin layer containing dispersed yellow colloidal silver, referred to in the art as Carey Lea silver. The yellow colloidal silver absorbs blue light during exposure and is easily decolored during bleaching and fixing steps of the photographic processing. However, the manufacture of dispersed yellow colloidal silver is expensive, requires time and skill, and the finished dispersion must be maintained in refrigerator stores. Also, the yellow silver can give rise to unwanted photographic fog at the boundaries between the yellow filter layer and the silver halide emulsion layers, so that it may be necessary to coat a barrier layer on each side of the yellow filter layer. Furthermore, the yellow colloidal silver has some adsorption in the green region of the spectrum which results in a diminished effective speed of the element.

It has already been proposed to use yellow dyes as replacement for yellow colloidal silver in yellow filter layers. Yellow dyes as alternatives for yellow colloidal silver are described, for example, in U.S. Pat. Nos. 2,538,008, 2,538,009, and 4,420,555, and GB 695,873 and 760,739. Many of these dyes, although they exhibit satisfactory absorption characteristics, are not completely satisfactory in respect to non-diffusibilty, residual stain after photographic processing, and incubative stain due to reaction with other components of the photographic element.

U.S. Pat. No. 4,923,788 and EP 697,758 describe other yellow dye filters free from drawbacks associated with colloidal silver and other yellow dyes, such as fogging, diffusion, post processing residual stain, and incubative stain.

Therefore, there is still the need in the photographic art to provide satisfactory yellow filter dyes.

SUMMARY OF THE INVENTION

The present invention relates to photographic elements having on a support a silver halide emulsion layer sensitive to radiation other than blue light in addition to its intrinsic sensitivity to blue region, and a yellow filter layer between the silver halide emulsion layers and the source of exposure, the yellow filter layer containing a yellow filter dye represented by the structural formula (I):

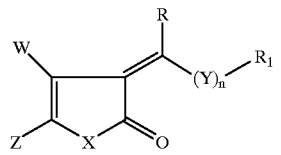

wherein:

R is hydrogen, alkyl group or aryl group;

$R_1$ is aryl group or heterocyclic group;

X is O or N—$R_2$ where $R_2$ is hydrogen or alkyl group;

Y is N—$R_3$ where $R_3$ is hydrogen or alkyl group;

n is 0 or 1;

Z is hydrogen, alkyl group or aryl group;

W is hydrogen, or W and Z, taken together, represent the atoms necessary to form an aryl group.

In particular, the present invention relates to multilayer color photographic elements comprising a support base having deposited thereon, in order from the support, a red-sensitive silver halide emulsion layer, a green-sensitive silver halide emulsion layer, and a blue-sensitive silver halide emulsion layer respectively associated with non-diffusing cyan, magenta and yellow dye-forming couplers, wherein a yellow filter layer containing yellow filter dye of the above formula (I) is positioned below the blue-sensitive layer and above the green-sensitive layer and the red-sensitive layer.

The photographic elements of the present invention provide yellow filter layers which have the required spectral absorption characteristics, are easily bleached during photographic processing steps and do not suffer from stain problems after processing and incubative aging.

DETAILED DESCRIPTION OF THE INVENTION

A photographic element is provided that incorporates a yellow filter layer containing a yellow filter dye represented by the structural formula (I):

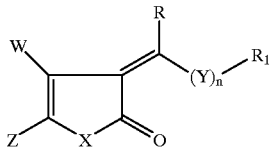

In the above formula (I), R is hydrogen, substituted or unsubstituted alkyl group or substituted or unsubstituted aryl group. Preferred alkyl groups for R include alkyl containing 1 to 8 carbon atoms, including straight chain or branched chain alkyl, such as methyl, trifluoromethyl, ethyl, propyl, isopropyl, butyl, t-butyl and octyl. Preferred aryl groups for R include aryl of from 6 to 10 carbon atoms, such as phenyl and naphthyl. These alkyl and aryl groups may be substituted with any known substituents for alkyl and aryl groups, such as halogen, hydroxy, sulfo, sulfato, sulfonamido, carboxyl, amino, alkyl, alkoxy.

$R_1$ is an aryl group or heterocyclic group. Preferred aryl groups for $R_1$ include an aryl group having from 6 to 10 carbon atoms, such as phenyl and naphthyl. These aryl groups may be substituted with any known substituents for aryl groups. Useful substituents for the aryl group include aryloxy (e.g., phenoxy, p-methoxyphenoxy, p-methylphenoxy, naphthyloxy, and tolyloxy); acylamino (e.g., acetamido, benzamido, butyramido, and t-butylcarbonamido); sulfonamido (e.g., methylsulfonamido, benzenesulfonamido, and p-toluylsulfonamido); sulfamoyl (e.g., N-methylsulfamoyl, N,N-diethylsulfamoyl, and N,N-di-methylsulfamoyl); carbamoyl (e.g., N-methylcarbamoyl, and N,N-dimethylcarbamoyl); arylsulfonyl (e.g., tolylsulfonyl); aryloxycarbonyl (e.g., phenoxycarbonyl); alkoxycarbonyl (i.e., alkoxycarbonyl containing 2 to 10 carbon atoms, for example methoxycarbonyl, ethoxycarbonyl, and benzyloxycarbonyl); alkoxysulfonyl (i.e., alkoxysulfonyl containing 2 to 10 carbon atoms, for example, methoxysulfonyl, octyloxysulfonyl, and 2-ethylhexylsulfonyl; aryloxysulfonyl (e.g., phenoxysulfonyl); alkylureido e.g., N-methylureido, N,N-dimethylureido, and N,N-dibutylureido); arylureido (e.g., phenylureido); alkyl; alkoxy; nitro; cyano; hydroxyl; sulfo; carboxyl; and sulfato.

Examples of heterocyclic groups for $R_1$ include furan, thiophene, pyrrole, pyrazole, pyridine, benzofuran, imidazole and benzoimidazole. The heterocyclic groups may be substituted as described with respect to thearyl groups.

$R_2$ and $R_3$ each represent hydrogen or alkyl group. Preferred alkyl groups include alkyl from 1 to 4 carbon atoms, including straight chain or branched chain alkyl, such as methyl, ethyl, propyl, isopropyl, butyl, isobutyl, t-butyl. $R_2$ and $R_3$ may be substituted, for example, with substituents as those described herein for R and $R_1$.

Z is hydrogen, alkyl group, aryl group or represents the atoms necessary, together with W, to form an aryl group. Preferred alkyl groups for Z include alkyl groups containing 1 to 8 carbon atoms, which may be substituted, as described above with respect to R. Preferred aryl groups for R include aryl of from 6 to 10 carbon atoms, such as phenyl and naphthyl, which may be substituted, as described above with respect to R. When Z is hydrogen, alkyl group or aryl group, W is hydrogen.

Among the substituents of groups on formula (I), the yellow filter dyes for use in the present invention may include solubilizing groups. Such solubilizing groups are known in the art and include, for example, sulfo, sulfato, carboxyl, and sulfonamido groups.

In a preferred embodiment, yellow filter dyes for use in the present invention may include a ballasting group, i.e., an organic group of such size and configuration as to render the yellow filter dye to which it is attached non-diffusible from the yellow filter layer in which it is coated in a photographic element. The ballasting group includes an organic: hydrophobic residue having 8 to 32 carbon atoms bonded to the yellow filter dye either directly or through a divalent linking group, such as an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 3,892,572, 4,138,258, and 4,451,559, and in GB 1,494,777.

When the term "group" is used in this invention to describe a chemical compound or substituent, the described chemical material includes the basic group and that group with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen, cyano, hydroxyl, nitro, amino, carboxylate, etc. On the other hand, "alkyl moiety" includes only methyl, ethyl, stearyl, cyclohexyl, etc.

Specific examples of yellow dyes for use in the present invention are illustrated below with their wavelength of maximum spectral absorption (λmax) measured in methanol, but the present invention should not be construed as being limited thereto.

(1) λmax = 426.0 nm

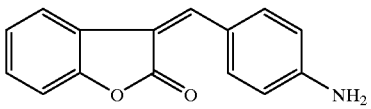

-continued (2) λmax = 426.0 nm

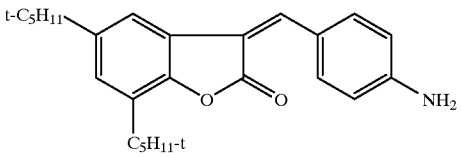

(3) λmax = 442.0 nm

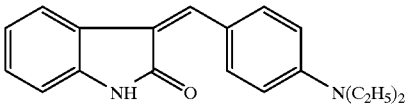

(4) λmax = 456.0 nm

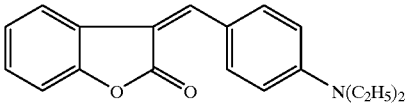

(5) λmax = 409.2 nm

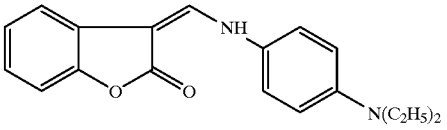

(6) λmax = 418.8 nm

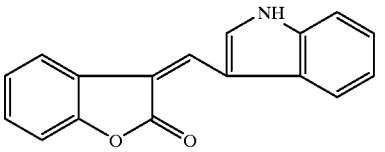

(7) λmax = 407.0 nm

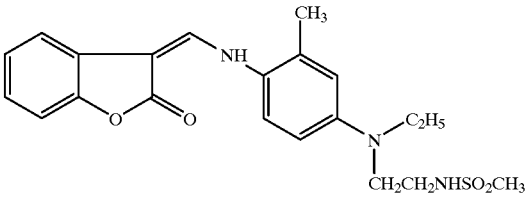

(8) λmax = 439.2 nm

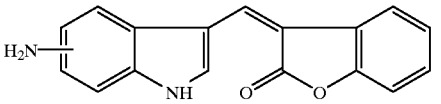

(9) λmax = 421.2 nm

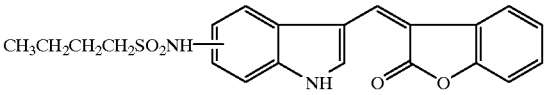

(10) λmax = 434.0 nm

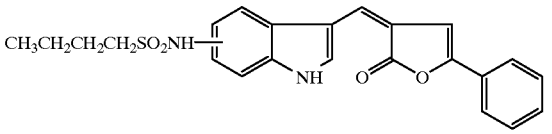

The yellow filter dyes of formula (I) can be prepared according to procedures well known in the art of organic chemical dyes. The synthesis of dyes according to formula (I) is described below in detail in the preparative examples.

The dye of formula (I) is present in the yellow filter layer in an amount effective to absorb the blue radiation. Typically, the yellow filter layer will contain about 0.1 to 1.0, preferably about 0.15 to 0.7, gram of yellow dye per square meter. The yellow dye will provide an optical density of 0.5 to 3.0, preferably 0.8 to 2.0, density units at its λmax which is typically in the range of 400 to 470, preferably 410 to 440, nm. However, these amounts, ratios and optical densities can be varied outside the above ranges depending upon such factors as the particular photographic element, the yellow filter location in the element, and the amount of blue radiation which is desired to be absorbed by the yellow filter layer.

The yellow filter dyes are incorporated into the film forming polymeric binders of the yellow filter layer, such as binders employed in the silver halide emulsion layers as known in the art. Useful binders include naturally occurring polymers such as gelatin and gelatin derivatives, and synthetic organic polymers such as polyvinyl alcohols and their derivatives, acrylamide polymers, polyvinylacetals, polyacrylates, and additional binders as described in *Research Disclosure,* 17643, paragraph IX, December 1978.

Methods for incorporating the dye in the binder of the yellow filter layer can vary according to the specific formula and substituents of the dye. For example, when the dye comprises one or more sulfo groups and is mobile in the binder, it may be advantageous to use the dye in combination with cationic polymeric mordants, such as those derived from polyvinylpyridine and polyvinylimidazole, for the purpose of imobilizing the dye in the layer. The technique of mordanting dyes is well known in the art as described, for example, in U.S. Pat. Nos. 3,282,699, 3,438,779 and 3,455,693. Also, when the dye comprises a solubilizing group having an ionizable proton (e.g., a carboxyl or sulfonamido group) which renders the dye insoluble at acid to neutral coating pH's and soluble at neutral to basic processing pH's, it may be advantageous to use the dye in the form of solid particle dispersions formed either by milling or precipitating the dye. The technique of dispersing dyes in solid particle form is described, for example, in WO 8804794. Alternatively, the yellow filter layer according to the present invention can comprise the yellow filter dye dispersed in a polymeric latex. The dye is loaded into the polymeric latex, either during or after the polymerization, and the latex is dispersed in the binder of the yellow filter layer. The technique for loading a dye into a polymeric latex is described, for example, U.S. Pat. Nos. 3,418,127, 4,203,716, 4,214,047, *Research Disclosure,* 15930, July 1977, and *Research Disclosure,* 19551, July 1980.

In a preferred embodiment, when the yellow filter dye comprises a ballasting chain, the filter layer for use in the present invention comprises the dye incorporated in the binder of the layer in the form of a dispersion of fine droplets consisting of a water-immiscible solvent in which said dye has been dissolved. According to the dispersion technique, as described, for example, in U.S. Pat. No. 2,322,027, the dye is generally dissolved in water-immiscible high boiling organic solvents (also called in the art permanent solvents, crystalloidal solvents, oil-type solvents, oil-formers and the like) and the resulting organic solution is added to an aqueous composition containing a hydrophilic colloid (gelatin) and a dispersing agent (surfactant). The mixture is then passed through a homogenizing apparatus to form a dispersion of fine droplets (having a mean diameter of 1 μm or less) of the organic solvent containing the dye. In some cases, it may be advantageous to facilitate the dissolution of the dye by using an auxiliary water-immiscible or water-miscible low boiling organic solvent, which is removed afterwards by evaporation. The resulted dispersion is then mixed with the hydrophilic colloid composition (gelatin) which is coated to form the yellow filter layer.

Water-immiscible high-boiling organic solvents for dispersing the yellow filter dyes are well known in the art, as disclosed for example in U.S. Pat. Nos. 2,322,027, 2,801,171, 2,835,579, 2,533,514, 3,554,755, 3,748,141, 3,799,765, 4,353,979, 4,430,421 and 4,430,422. Examples of useful organic solvents include N-butylacetanilide, triphenylphosphate, dibutylphthalate, tricresylphosphate, N,N-diethyldodecanamide, N,N-dibutyldodecanamide, tris (2-ethylhexyl)phosphate, acetyl tributyl citrate, 2,4-di-tert-pentylphenol, 2-(2-butoxyethoxy)ethyl acetate, 1,4-cyclohexyldimethylene bis(2-ethylhexanoate), bis-(2-ethylhexyl) phthalate.

Auxiliary water-immiscible or water-miscible low boiling organic solvents are well known in the art, as described, for example, in U.S. Pat. Nos. 2,801,170, 2,801,171 and 2,949,360. Examples of useful auxiliary organic solvents include ethyl acetate, carbon tetrachloride, methyl ethyl ketone, benzene, ligroine, methanol, ethanol, dimethylsulfoxide, tetrahydrofuran, dioxan, and acetone.

The yellow filter layer containing the yellow filter dye (I) can be used in any photographic element where it is desirable to absorb blue light. The yellow filter layer is especially useful in photographic elements having at least one silver halide emulsion layer that is sensitive to at least one portion of radiation of the electromagnetic spectrum other than blue light in addition to its intrinsic sensitivity to blue light. In such a case, the yellow filter layer can be used to reduce or prevent blue light from reaching this silver halide emulsion layer, and to assure the response of the silver halide emulsion to the radiation to which it is sensitized rather than to blue light.

The yellow filter layer is especially advantageously used in multilayer color photographic elements containing layers sensitive to red, green and blue regions of the visible spectrum. In such elements, it is preferred that the yellow filter layer be positioned below the blue-sensitive layers and above the green- and red-sensitive layers.

Silver halide multilayer color photographic elements usually comprise a support having coated thereon, in order, a red-sensitive silver halide emulsion layer associated with cyan dye-forming color couplers, a green-sensitive silver halide emulsion layer associated with magenta dye-forming color couplers and a blue-sensitive silver halide emulsion layer associated with yellow dye-forming color couplers. Each red-, green- and blue-sensitive layer is usually comprised of multiple (two or more) emulsion sub-layers sensitive to a given region of visible spectrum. When multilayer materials contain multiple red, green and blue sub-layers, these can be case relatively faster and relatively slower sub-layers. These elements additionally comprise other non-light sensitive layers, such as intermediate layers, filter layers, antihalation layers and protective layers, thus forming a multilayer structure. The color photographic elements, after imagewise exposure to actinic radiation, are processed in a chromogenic developer to yield a visible color image. The layer units can be coated in a layer arrangement comprising the red-sensitive layers coated nearest the support and overcoated, in order, by the green-sensitive layers, a yellow filter layer and the blue-sensitive layers.

The multilayer silver halide color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromo-chloride containing 1 to 20% mole silver iodide. In silver iodobromide emulsions or silver iodo-bromo-chloride, the iodide can be uniformly distributed among the emulsion grains, or iodide level can varied among the grains. The silver halides can have a uniform grain size distribution or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 $\mu$m, more preferably from 0.4 to 1.5 $\mu$m. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in the photographic elements of this invention are those which employ one or more light-sensitive tabular grain emulsions. Useful tabular silver halide grains have an average diameter:thickness ratio (often referred to in the art as aspect ratio) of at least 2:1, preferably 2:1 to 20:1, more preferably 3:1 to 14:1, and most preferably 3:1 to 8:1. Suitable average diameters of the tabular silver halide grains range from about 0.3 $\mu$m to about 5 $\mu$m, preferably 0.5 $\mu$m to 3 $\mu$m, more preferably 0.8 $\mu$m to 1.5 $\mu$m. The tabular silver halide grains suitable for use in this invention have a thickness of less than 0.4 $\mu$m, preferably less than 0.3 $\mu$m and more preferably less than 0.2 $\mu$m.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 $\mu$m, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, and 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, and 1,302,405, U.S. Pat. Nos. 3,801,326, 4,046,376, 3,790,386, 3,897,935, 4,147,551, and 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic element from crystallizing out after coating and other photographic or mechanical disadvantages (stickiness, brittleness, etc.), the soluble salts formed during precipitation have to be removed.

In preparing the silver halide emulsions, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion can be chemically sensitized using sensitizing agents known in the art. Sulfur containing compounds, gold and noble metal compounds, and polyoxyalkylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a vater soluble salt such as, for instance, of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion can be spectrally sensitized with dyes from a variety of classes, including the polymethyne dye class, which includes the cyanines, merocyanines, complex cyanines ;3nd merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process,* 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

The silver halide emulsion can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

The non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, which is the 1-phenyl-3-anilino-4-phenylthio-5-pyrazolone described above, is associated with green-sensitive silver halide emulsion layers and at least one non-diffusible yellow image forming color coupler, generally an acylacetanilide compound, is associated with blue-sensitive silver halide emulsion layers.

The color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in GB 1,201,110, and in Research Disclosure 308119, Section VII, 1989.

The most useful magenta-forming couplers are those described above.

The most useful yellow-forming couplers which can be used in combination with the yellow dye-forming couplers described hereinbefore are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE 2,219,917, 2,261,361 and 2,414,006, in GB 1,425,020, in JP 10,783/76, 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP 2,016/69, 22,335/63, 11,304/67, 32,461/69, 26,034/76 and 42,121/77 and in DE 2,418,959. The light-sensitive silver halide color photographic element may contain high molecular weight color couplers as described for example in U.S. Pat. No. 4,080,211, in EP 27,284 and in DE 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in GB 1,464,361. Colorless couplers can be selected from those described in GB 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB 2,125,570 and yellow, magenta and cyan couplers described in EP 96,873, in DE 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator, either directly or after removal of one or further groups from the group originally released. Examples of such 2-equivalent couplers include the known DIR couplers as well as DAR and FAR couplers. Typical examples of said couplers are described in DE 2,703,145, 2,855,697, 3,105,026, 3,319,428, 1,800,420, 2,015,867, 2,414,006, 2,842,063, 3,427,235, 3,209,110, and 1,547,640, in GB 953,454 and 1,591,641, in EP 89,843, 117,511, 118,087, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German 2,405,442; 2,523,705; 2,460,202; 2,529,350 and 2,448,063; in Japanese 143,538/75 and 147,716/75, in GB 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE 853,512 and 869,816, in U.S. Pat. Nos. 4,214,047 and 4,199,363 and in EP 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate or PET film supports and polyethylene naphthalate or PEN film supports), and the like, as described in Research Disclosure 308119, Section XVII, 1989.

The photographic elements according to this invention can be processed after exposure to form a visible image. During processing, the yellow filter dye of formula (I) will be generally bleached and/or discharged. Typically, after processing, the yellow filter layer will contribute less than 0.05, preferably less than 0.02, density unit to the minimum density areas of the exposed and processed element. Processing can be the common processing employed to develop color photographic elements. A negative colored image can be obtained by color development followed by bleaching and fixing. Development is obtained by contacting the exposed silver halides of the element with an alkaline aqueous medium in the presence of an aromatic primary amine color developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylenediamine derivatives, especially the N,N-dialkyl-p-phenylenediamine derivatives wherein the alkyl groups or the aromatic nucleus can be substituted or not substituted.

Examples of p-phenylenediamine developers include the salts of: N,N-diethyl-p-phenylenediamine, 2-amino-5-diethylamino-toluene, 4-amino-N-ethyl-N-(α-methanesulphonamidoethyl)-m-toluidine, 4-amino-3-methyl-N-ethyl-N-(α-hy-droxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

The color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.NH4, wherein EDTA is the ethylenediamino-tetracetic acid, or PDTA.Fe.NH4, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

SYNTHESIS EXAMPLE 1

Preparation of Dye (1)

A mixture of commercially available 2-coumaranone (5.0 g, 37.3 mmol), 4-aminobenzaldehyde (4.97 g, 41.0 mmol) and sodium acetate (1.0 g, 12.2 mmol) was refluxed in 60 ml of acetic acid for three hours. The mixture was then cooled to room temperature and the precipitated solid was collected by filtration, washed with acetic acid and dried. 7.1 g (80% yield) of Dye (1) were isolated as an orange solid having a λmax=426.0 nm measured in methanol. All analytical data were consistent with the structure.

SYNTHESIS EXAMPLE 2

Preparation of Dye (2)

Compound A of formula

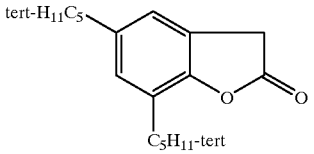

was prepared according to the general procedure described by R. W. Layer in *J. Het. Chem.* 24, 1067 (1975). A mixture of compound A (27.5 g, 0.1 mol), 4-aminobenzaldehyde (13.3 g, 0.11 mol) and sodium acetate (2.5 g, 0.03 mol) was refluxed in 160 ml of acetic acid for three hours. The mixture was then cooled to room temperature and poured in water, extracted with ethyl acetate and the extracts dried over sodium sulfate and filtered. The filtrate was concentrated to an oil which was eluted through a silica gel column using 70:30 eptane:ethyl acetate. Upon solvent evaporation, 19.0 g (yield 50%) of Dye (2) were obtained as a red oil which slowly solidified having a λmax=426.0 nm measured in methanol. All analytical data were consistent with the structure.

EXAMPLE 1

A multilayer color photographic element (Sample 101) was prepared coating the following compositions on a transparent cellulose acetate film support having a gelatin subbing layer. In the following compositions, the coating amounts of silver halide emulsions, gelatin and other additives are reported in grams per square meter (g/m$^2$). The amounts of silver halide emulsions and colloidal silver are coating weights (g/m$^2$) expressed as silver. All silver halide emulsions were stabilized with 4-hydroxy-6-methyl-1,3,3a,7-tetrazaindene and spectrally sensitized with the appropriate spectral red, green or blue sensitizing dyes.

| | |
|---|---|
| Layer 1 {Antihalation Layer} | |
| Black colloidal silver | 0.190 |
| Gelatin | 1.350 |
| Dye 1 | 0.032 |
| Dye 2 | 0.071 |
| Magenta Masking Coupler MM-1 | 0.036 |
| Magenta Masking Coupler MM-2 | 0.018 |
| Solv-1 | 0.212 |
| Solv-4 | 0.080 |
| Layer 2 {Interlayer} | |
| Gelatin | 1.110 |
| Cpd-1 | 0.020 |
| UV-1 | 0.108 |
| Solv-2 | 0.098 |
| Solv-3 | 0.042 |
| Solv-4 | 0.025 |
| Layer 3 {1st (Least) Red-Sensitive Emulsion Layer} | |
| Silver Iodobromide Emulsion (AgI 2.5 mol %, average diameter 0.22 μm) | 0.650 |
| Gelatin | 1.290 |
| Cyan coupler C-1 | 0.314 |
| DIR Coupler D-1 | 0.018 |
| Cyan Masking Coupler CM-1 | 0.008 |
| Dye 1 | 0.005 |
| Dye 2 | 0.014 |
| Solv-1 | 0.275 |
| Solv-3 | 0.543 |
| Layer 4 {2nd (More) Red-Sensitive Emulsion Layer} | |
| Silver Iodobromide Emulsion (AgI 6 mol % average diameter 0.60 μm) | 0.660 |
| Gelatin | 1.040 |
| Cyan coupler C-1 | 0.256 |
| DIR Coupler D-1 | 0.015 |
| Cyan Masking Coupler CM-1 | 0.035 |
| Solv-1 | 0.189 |
| Solv-3 | 0.442 |
| Layer 5 {3rd (Most) Red-Sensitive Emulsion Layer} | |
| Silver Iodobromide Emulsion (AgI 12 mol % average diameter 1.10 μm) | 0.990 |
| Gelatin | 1.180 |
| Cyan coupler C-1 | 0.143 |
| DIR Coupler D-1 | 0.012 |

-continued

| | |
|---|---|
| Cyan Masking Coupler CM-1 | 0.020 |
| Solv-1 | 0.106 |
| Solv-4 | 0.106 |
| Layer 6 {Interlayer} | |
| Gelatin | 1.240 |
| Cpd-1 | 0.056 |
| Solv-4 | 0.070 |
| Hardener H-1 | 0.073 |
| Layer 7 {1st (Least) Green-Sensitive Layer} | |
| Silver Iodobromide Emulsion (AgI 2.5 mol %, average diameter 0.22 μm) | 0.410 |
| Gelatin | 1.220 |
| Magenta Coupler M-1 | 0.281 |
| Magenta Masking Coupler MM-1 | 0.026 |
| Magenta Masking Coupler MM-2 | 0.014 |
| Cpd-1 | 0.080 |
| Solv-4 | 0.329 |
| Layer 8 {2nd (More) Green-Sensitive Layer} | |
| Silver Iodobromide Emulsion (AgI 6.0 mol %, average diameter 0.60 μm) | 0.720 |
| Gelatin | 1.160 |
| Magenta Coupler M-1 | 0.142 |
| DIR Coupler D-2 | 0.012 |
| Magenta Masking Coupler MM-1 | 0.043 |
| Magenta Masking Coupler MM-2 | 0.021 |
| Cpd-1 | 0.011 |
| Solv-1 | 0.060 |
| Solv-4 | 0.241 |
| Layer 9 {3rd (Most) Green-Sensitive Layer} | |
| Silver Iodobromide Emulsion (AgI 12.0 mol %, average diameter 1.10 μm) | 1.180 |
| Gelatin | 1.580 |
| Magenta Coupler M-1 | 0.207 |
| DIR Coupler D-2 | 0.020 |
| Magenta Masking Coupler MM-1 | 0.040 |
| Magenta Masking Coupler MM-2 | 0.020 |
| Cpd-1 | 0.011 |
| Solv-1 | 0.106 |
| Solv-4 | 0.303 |
| Layer 10 {Interlayer} | |
| Gelatin | 1.040 |
| Magenta Masking Coupler MM-1 | 0.026 |
| Magenta Masking Coupler MM-2 | 0.014 |
| Solv-4 | 0.060 |
| Layer 11 {Yellow Filter Layer} | |
| Yellow Colloidal Silver | 0.055 |
| Gelatin | 1.020 |
| Hardener H-1 | 0.064 |
| Layer 12 {1st (Less) Blue-Sensitive Layer} | |
| Silver Iodobromide Emulsion (AgI 2.5 mol %, average diameter 0.22 μm) | 0.210 |
| Silver Iodobromide Emulsion (AgI 6.0 mol %, average diameter 0.60 μm) | 0.230 |
| Gelatin | 1.090 |
| Yellow Coupler Y-1 | 0.754 |
| DIR Coupler D-3 | 0.040 |
| Solv-5 | 0.226 |
| Solv-1 | 0.226 |
| Layer 13 {2nd (More) Blue-Sensitive Layer} | |
| Silver Iodobromide Emulsion (AgI 12 mol %, average diameter 1.10 μm) | 0.550 |
| Gelatin | 1.360 |
| Yellow Coupler Y-1 | 0.325 |
| DIR Coupler D-3 | 0.033 |
| DIR Coupler D-4 | 0.016 |
| Cyan Coupler C-2 | 0.008 |
| Solv-5 | 0.109 |
| Solv-1 | 0.109 |

-continued

| | |
|---|---|
| Layer 14 {First Protective Layer} | |
| Unsensitized Silver Bromide Lippmann Emulsion | 0.200 |
| Gelatin | 1.120 |
| UV-1 | 0.095 |
| UV-2 | 0.095 |
| Solv-1 | 0.210 |
| Layer 15 {Second Protective Layer} | |
| Gelatin | 0.085 |
| Matte Polymethylmethacrylate Beads | 0.013 |
| Matte Copoly(ethylmethacrylate-methacrylic acid) Beads | 0.172 |
| Hardener H-2 | 0.374 |

Multilayer color photographic element (Sample 102) was prepared in the same manner as Sample 101, but omitting layer 10 of Sample 101 and adding to layer 1 the amounts of Dye 1 and Dye 2 of layer 10 of Sample 101.

Multilayer color photographic elements (Samples 103–106) were prepared in the same manner as Sample 102, but replacing the yellow colloidal silver (Carey Lea silver) in the yellow filter layer with yellow filter dyes.

The following Table 1 reports the constitution of yellow filter layer of Samples 101–106 as far as Carey Lea silver and yellow dyes is concerned. The Carey Lea silver and the yellow dyes were used at levels to give equivalent filtering of blue light in their respective elements.

TABLE 1

| Sample | Yellow Silver/Dye | Silver/Dye Amount (g/m$^2$) |
|---|---|---|
| 101 (comp.) | Carey Lea Silver | 0.055 |
| 102 (comp.) | Carey Lea Silver | 0.055 |
| 103 (comp.) | Dye A | 0.108 |
| 104 (inv.) | Dye (1) | 0.054 |
| 105 (inv.) | Dye (2) | 0.108 |
| 106 (comp.) | Dye B | 0.143 |

The yellow dyes were introduced into the coating compositions of their respective yellow filter layers by dispersing them in gelatin using a rotatory homogenizer. The following Table 2 reports the constitution of the dispersions of yellow dyes used in the yellow filter layers of Samples 103–106. The amounts are in g/m$^2$.

TABLE 2

| | Sample | | | |
|---|---|---|---|---|
| | 103 | 104 | 105 | 106 |
| Yellow Dye A | 4.00 | / | / | / |
| Yellow Dye (1) | / | 4.00 | / | / |
| Yellow Dye (2) | / | / | 4.00 | / |
| Yellow Dye B | / | / | / | 4.00 |
| Cpd-1 | 2.78 | 2.78 | 2.78 | 2.78 |
| Irganox ™ 1076 | 0.37 | 0.37 | 0.37 | 0.37 |
| Solv-3 | 8.00 | / | / | / |
| Solv-1 | / | 8.00 | 8.00 | 8.00 |
| Ethyl Acetate | 12.00 | 12.00 | 12.00 | 12.00 |
| Gelatin 10% w/w | 60.00 | 60.00 | 60.00 | 60.00 |
| Hostapur ™ 10% w/w | 6.00 | 6.00 | 6.00 | 6.00 |
| Water | 6.85 | 6.85 | 6.85 | 6.85 |

In Table 2, Irganox™ 1076 is a phenol antioxidant sold by Ciba Geigy AG, and Hostapur™ is a sec-alkane sulfonate, sodium salt, surfactant sold by Hoechst AG.

Samples 101–106 were individually exposed to a light source having a color temperature of 5500 K through an optical step wedge (neutral exposure). Other samples of each film were exposed to the light source having a color temperature of 5500 K through a Kodak Wratten™ W99 filter and the optical step wedge (selective exposure of the green sensitive layers or green exposure). All the exposed samples were processed in accordance with the Kodak C-41 color negative process (as described in British Journal of Photography Annual, pp. 196–198, 1988). The minimum density, the maximum density and the speed (at 0.2 and 1.00 above minimum density) of the green-sensitive layers of Samples 101–106 are reported in Tables 3 and 4.

TABLE 3

| | Neutral Exposure | | | |
|---|---|---|---|---|
| Sample | Dmin | Dmax | Speed 0.2 | Speed 1.0 |
| 101 (comp.) | 0.71 | 2.42 | 2.03 | 0.56 |
| 102 (comp.) | 0.76 | 2.47 | 2.00 | 0.53 |
| 103 (comp.) | 0.68 | 2.50 | 2.14 | 0.80 |
| 104 (inv.) | 0.67 | 2.55 | 2.16 | 0.81 |
| 105 (inv.) | 0.68 | 2.49 | 2.05 | 0.72 |
| 106 (comp.) | 0.70 | 2.55 | 2.08 | 0.76 |

TABLE 4

| | Green Exposure | | | |
|---|---|---|---|---|
| Sample | Dmin | Dmax | Speed 0.2 | Speed 1.0 |
| 101 (comp.) | 0.71 | 2.30 | 1.50 | 0.22 |
| 102 (comp.) | 0.76 | 2.39 | 1.47 | 0.21 |
| 103 (comp.) | 0.68 | 2.43 | 1.52 | 0.38 |
| 104 (inv.) | 0.67 | 2.44 | 1.49 | 0.35 |
| 105 (inv.) | 0.68 | 2.41 | 1.49 | 0.33 |
| 106 (comp.) | 0.79 | 2.46 | 1.37 | 0.20 |

As shown in Tables 3 and 4, the dyes according to this invention are effective as yellow filter dyes in the photographic elements, yield less background density and cause lower loss in speed than does Carey Lea silver.

Samples 101–106, after coating, were subjected to accelerated tests, in order to evaluate the sensitometric stability and the effect of aging on the different photographic elements. The samples were stored for seven days at the following conditions:

| | |
|---|---|
| A | Shelf (21° C., 40–50% RH) |
| B | Dry hot (50° C., 50% RH) |
| C | Humid hot (38° C., 75% RH) |

After aging, the samples were reconditioned to room conditions then exposed and processed as described above. The results are reported in the following Table 5 and 6 as difference in the sensitometric data for the differently aged samples (dry hot or humid hot) versus the unaged samples (shelf).

TABLE 5

| Sample | ΔDmin | ΔDmax | ΔSpeed 0.2 | ΔSpeed 1.0 |
|---|---|---|---|---|
| Dry Hot - Shelf | | | | |
| Green-sensitive Layers | | | | |
| 101 (comp.) | 0.02 | −0.02 | −0.11 | −0.01 |
| 102 (comp.) | 0.01 | −0.03 | −0.10 | −0.03 |
| 103 (comp.) | 0.06 | −0.03 | −0.14 | −0.10 |
| 104 (inv.) | 0.01 | −0.02 | −0.07 | 0.00 |
| 105 (inv.) | 0.00 | −0.01 | −0.05 | 0.04 |
| 106 (comp.) | −0.01 | −0.02 | −0.09 | 0.01 |
| Blue-sensitive Layers | | | | |
| 101 (comp.) | −0.01 | −0.01 | 0.06 | 0.03 |
| 102 (comp.) | 0.00 | −0.04 | 0.02 | −0.01 |
| 103 (comp.) | 0.05 | 0.03 | −0.09 | −0.07 |
| 104 (inv.) | 0.03 | 0.03 | −0.06 | −0.01 |
| 105 (inv.) | −0.01 | −0.02 | 0.01 | 0.04 |
| 106 (comp.) | 0.01 | 0.01 | −0.01 | 0.01 |

TABLE 6

| Sample | ΔDmin | ΔDmax | ΔSpeed 0.2 | ΔSpeed 1.0 |
|---|---|---|---|---|
| Humid Hot - Shelf | | | | |
| Green-sensitive Layers | | | | |
| 101 (comp.) | 0.03 | 0.07 | −0.12 | −0.03 |
| 102 (comp.) | 0.04 | 0.06 | −0.14 | −0.08 |
| 103 (comp.) | 0.00 | 0.07 | 0.01 | 0.04 |
| 104 (inv.) | 0.01 | 0.07 | 0.00 | 0.04 |
| 105 (inv.) | −0.01 | 0.05 | −0.02 | 0.05 |
| 106 (comp.) | −0.02 | 0.03 | −0.04 | 0.02 |
| Blue-sensitive Layers | | | | |
| 101 (comp.) | 0.00 | −0.01 | −0.12 | −0.15 |
| 102 (comp.) | 0.00 | −0.07 | −0.16 | −0.16 |
| 103 (comp.) | −0.03 | −0.02 | −0.39 | −0.33 |
| 104 (inv.) | 0.08 | 0.13 | −0.19 | −0.10 |
| 105 (inv.) | −0.08 | −0.11 | −0.14 | −0.19 |
| 106 (comp.) | 0.05 | −0.12 | −0.35 | −0.30 |

As will be observed from Tables 5 and 6, the yellow filter dyes according to this invention cause smaller loss in green and blue speeds than the Carey Lea silver and smaller loss in the blue speed than the comparison dyes.

Formulas for the compounds used in the Examples are as follows.

Yellow Dye A : λmax = 418.8 nm (U.S. 4,923,788)

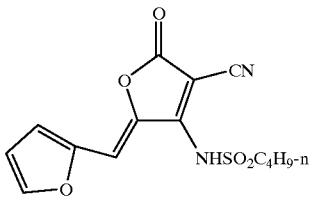

-continued

Yellow Dye B : λmax = 446.0 nm

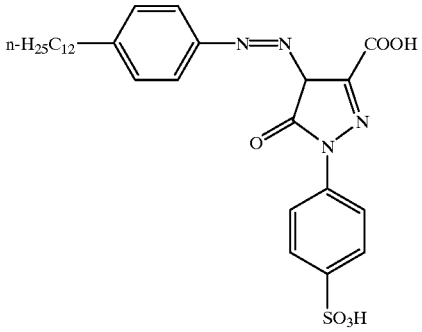

Dye 1:

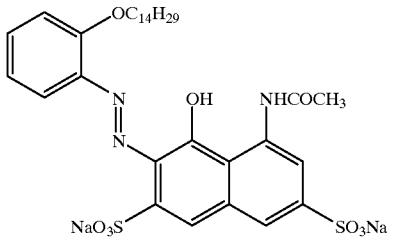

Dye 2:

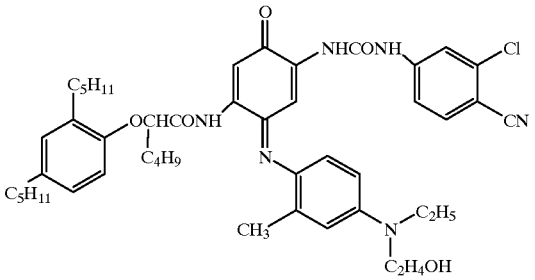

Cpd-1:

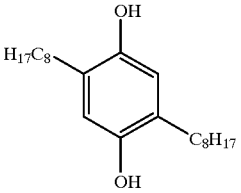

UV-1:

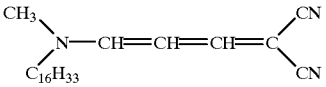

UV-2:

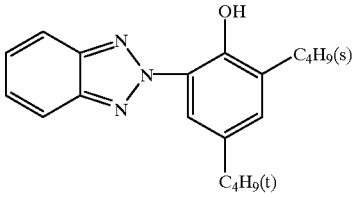

-continued

Cyan Coupler C-1:

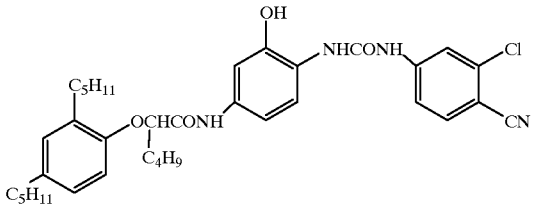

Cyan Coupler C-2:

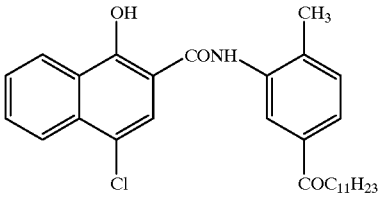

Cyan Masking Coupler CM-1:

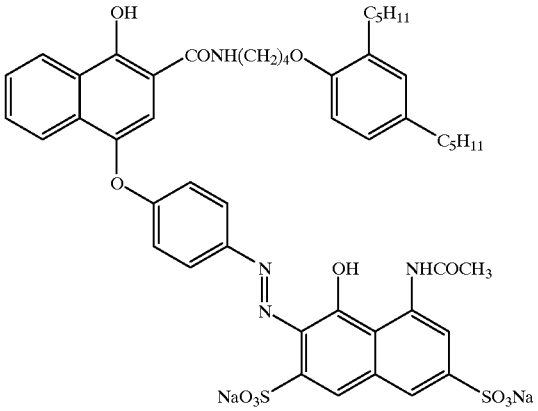

DIR Coupler D-1:

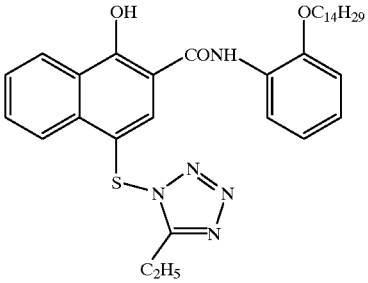

Solv-1: N-Butylacetanilide

Solv-2: Triphenyl Phosphate

Solv-3: Dibutylphthalate

Solv-4: Tricresyl Phosphate

Solv-5: Bis-(2-ethylhexyl)-phthalate

Hardener H-1:

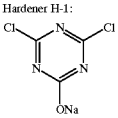

-continued

Magenta Coupler M-1:

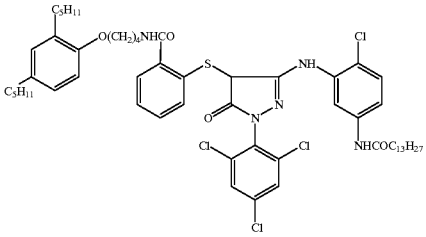

DIR Coupler D-2:

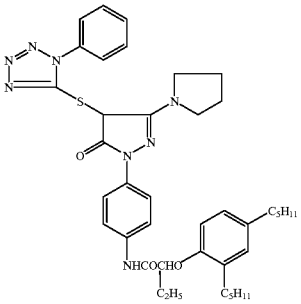

Magenta Masking Coupler MM-1:

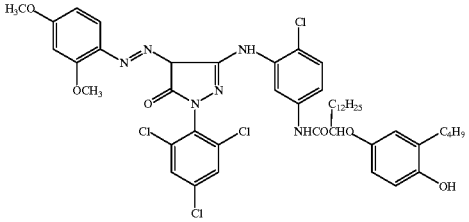

Magenta Masking Coupler MM-2:

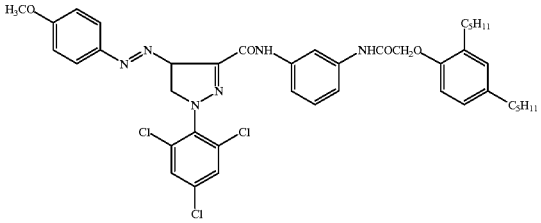

Yellow Coupler Y-1:

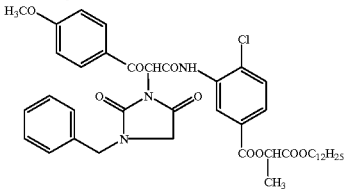

DIR Coupler D-3:

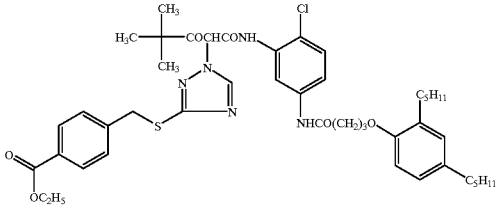

DIR Coupler D-4:

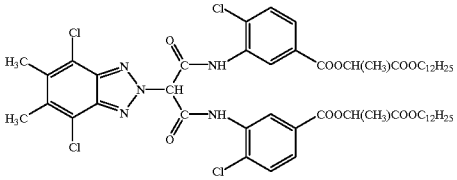

-continued

Cpd-2:
$(—CH_2NHCONH_2)_2$

Hardener H-2:

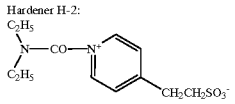

What is claimed is:

1. A silver halide photographic element comprising a support having deposited thereon at least one silver halide emulsion layer sensitive to radiation other than blue light in addition to its intrinsic sensitivity to blue region, and a yellow filter layer between the at least one silver halide emulsion layer and the source of exposure, wherein the yellow filter layer comprises a yellow filter dye represented by the structural formula:

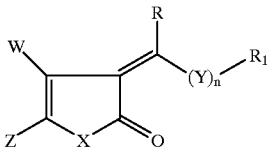

wherein:

R is hydrogen, alkyl group or aryl group;

$R_1$ is aryl group or heterocyclic group;

X is O or N—$R_2$ where $R_2$ is hydrogen or alkyl group;

Y is N—$R_3$ where $R_3$ is hydrogen or alkyl group;

n is 0 or 1; and

Z is hydrogen, alkyl group, or aryl group;

W is hydrogen, or W and Z taken together, represent the atoms necessary to form an aryl group, wherein a heterocyclic group formed by W, Z, and X is different from the heterocyclic group of $R_1$.

2. The silver halide photographic element of claim 1 wherein the yellow filter layer comprises at least one of the following dyes:

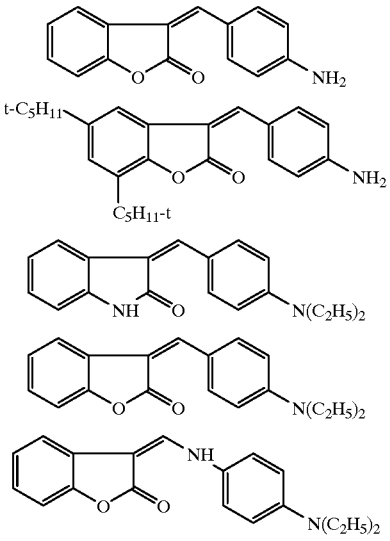

-continued

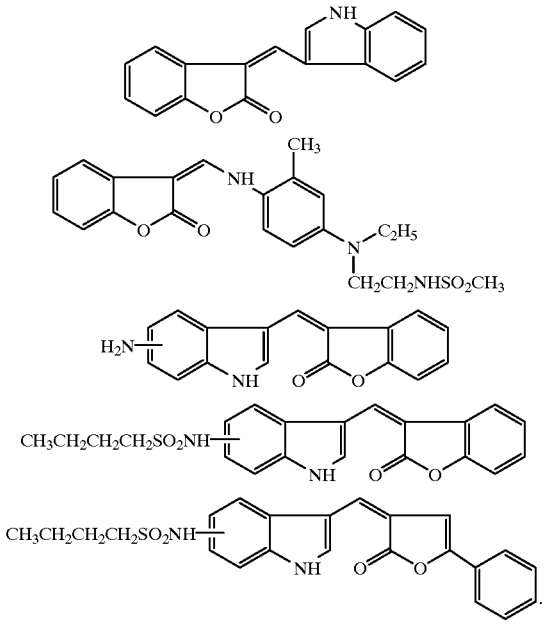

3. The silver halide photographic element of claim 1 wherein the yellow filter layer comprises 0.1 to 1.0 gram of yellow filter dye per square meter.

4. The silver halide photographic element of claim 1 wherein the yellow filter dye has an optical density of 0.5 to 3.0 density units at a λmax in the range of 400 to 470 nm.

5. A multilayer silver halide color photographic element comprising a support base having deposited thereon, in order, at least one red-sensitive silver halide emulsion layer associated with at least one non-diffusing cyan dye-forming coupler, at least one green-sensitive silver halide emulsion layer associated with at least one non-diffusing magenta dye-forming coupler, a yellow filter layer and at least one blue-sensitive silver halide emulsion layer associated with at least one non-diffusing yellow dye-forming coupler, wherein the yellow filter layer comprises a yellow filter dye represented by the structural formula:

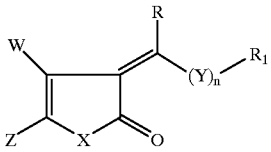

wherein:

R is hydrogen, alkyl group or aryl group;

$R_1$ is aryl group or heterocyclic group;

X is O or N—$R_2$ where $R_2$ is hydrogen or alkyl group;

Y is N—$R_3$ where $R_3$ is hydrogen or alkyl group;

n is 0 or 1; and

Z is hydrogen, alkyl group, or aryl group;

W is hydrogen, or W and Z, taken together, represent the atoms necessary to form an aryl group, wherein a heterocyclic group formed by W, Z and X is different from the heterocyclic group of $R_1$.

6. The multilayer silver halide color photographic element according to claim 5 wherein said at least one red-sensitive silver halide emulsion layer comprises, in order, an uppermost, intermediate and lowermost red-sensitive silver halide emulsion layer, sensitive to the same spectral region of visible light, in which the sensitivity of the three red-sensitive silver halide emulsion layers decreases in order from the uppermost silver halide emulsion layer to the lowermost silver halide emulsion layer, said at least one green-sensitive silver halide emulsion layer comprises, in order, an uppermost, intermediate and lowermost green-sensitive silver halide emulsion layer, sensitive to the same spectral region of visible light, in which the sensitivity of the three green-sensitive silver halide emulsion layers decreases in order from the uppermost silver halide emulsion layer to the lowermost silver halide emulsion layer, said yellow filter layer, and said at least one blue-sensitive silver halide emulsion layer comprises, in order, an uppermost and a lowermost blue-sensitive silver halide emulsion layer, sensitive to the same spectral region of visible light, in which the sensitivity of the two blue-sensitive silver halide emulsion layers decreases in order from the uppermost silver halide emulsion layer to the lowermost silver halide emulsion layer.

* * * * *